US005407264A

United States Patent [19]

Giegerich et al.

[11] Patent Number: 5,407,264

[45] Date of Patent: Apr. 18, 1995

[54] DRIVE MECHANISM FOR MOVING A HORIZONTAL SHELF IN A VENDING MACHINE

[75] Inventors: David K. Giegerich, Fair Lawn; Andris C. Sloss, Sussex, both of N.J.; Algert Maldanis, Heath, Tex.

[73] Assignee: Rowe International, Inc., Rockwall, Tex.

[21] Appl. No.: 72,597

[22] Filed: Jun. 3, 1993

[51] Int. Cl.[6] ..... A47B 49/00

[52] U.S. Cl. ..... 312/268; 198/799; 198/800

[58] Field of Search ..... 312/267, 268; 198/797, 198/798, 799, 800

[56] References Cited

U.S. PATENT DOCUMENTS

| | | | |
|---|---|---|---|
| 1,248,069 | 11/1917 | Buck | 198/798 |
| 1,592,069 | 7/1926 | Benson | 198/798 |
| 2,493,857 | 1/1950 | Cargill . | |
| 2,512,356 | 6/1950 | Massiello . | |
| 2,965,214 | 12/1960 | Schlumpf et al. . | |
| 3,202,265 | 8/1965 | Anders . | |
| 3,297,139 | 1/1967 | Speigle | 198/799 |
| 3,297,378 | 1/1967 | Krug et al. . | |
| 3,902,590 | 9/1975 | Raynor et al. | 198/158 |
| 4,942,290 | 7/1990 | Frerking . | |

OTHER PUBLICATIONS

Brochure of Rowe International, Inc. "Genesis TM. The Look of the Future from Rowe TM".

*Primary Examiner*—Richard A. Berisch
*Assistant Examiner*—Roland G. McAndrews, Jr.
*Attorney, Agent, or Firm*—John W. Montgomery; Ross, Howison, Clapp & Korn

[57] ABSTRACT

A drive mechanism for movement of a horizontal shelf in a vending machine includes first and second spaced apart rotatable sprockets. A continuous chain engages and extends around the first and second spaced apart sprockets. A plurality of brackets are attached to the continuous chain supported in a fixed angular relationship to the chain and at predetermined distances along the length of the chain for movement therewith upon rotation of the sprockets. Gear portions are affixed to the vending machine adjacent to and extending approximately 180° around the first and second sprocket. A planetary idler gear is rotatably mounted on the bracket for engagement with the track gear portions. The planetary idler gear is sized for having a predetermined gear ratio with the track gear. A pinion idler gear is coaxially affixed for co-rotation with the planetary idler gear thereby forming an idler gear pair mounted to the bracket for rotation relative to the bracket. A shelf gear is mounted to the bracket for rotation relative thereto and is positioned for engagement with the pinion idler gear. A shelf-receiving boss is rigidly affixed to the shelf gear with a clip thereon for receiving and holding a shelf in a fixed relationship to the shelf gear thereby holding the shelf in a constant angular position relative to the drive mechanism when the bracket traverses 180° around the first and second sprockets.

8 Claims, 3 Drawing Sheets

DRIVE MECHANISM FOR MOVING A HORIZONTAL SHELF IN A VENDING MACHINE

TECHNICAL FIELD OF THE INVENTION

This invention relates to a drive mechanism for use in a vending machine in which shelves are moved past a selection and dispensing area on a continuous conveyor system, and more particularly, to a vertical drive mechanism with gears for maintaining a plurality of movable shelves in a horizontal orientation as the shelves are moved vertically upward, around an 180° arc, vertically downward, and around another 180° arc to move upwardly again.

BACKGROUND OF THE INVENTION

Previously known vertically moving continuous conveyor mechanisms for vending machines have relied primarily on roller tracks having offset elliptical guide channels at the top and the bottom of the vertical travel for maintaining the shelves in a substantially horizontal orientation. For example, conveyor mechanisms such as those depicted in U.S. Pat. Nos. 3,297,378 to Krug, et al. and 3,202,265 to Anders rely upon "scissor" type linkage mechanisms and roller channel guides for maintaining horizontal orientation of the conveyor shelves. The scissor type linkage included two-point connection to the chain and a pivotable apex at which a shelf support arm is connected. The guide roller was mounted on the support arm so that it followed an elliptical guide channel. The entire force counter-rotating the shelf support arms and attached shelves to hold them in a horizontal orientation was exerted through the roller as it moves through the channel guides. The forces subjected the roller to wear and binding in the channel guides. Further, the linkage was subject to wear at each of the pivot points such that the likelihood of binding was accelerated and reliability was reduced.

Another device operating on a principle similar to the "scissor" linkage was disclosed in U.S. Pat. No. 4,942,290 issued to Frercking. Again, the horizontal position of the shelf was maintained through counter-rotating force exerted through a roller extending from a corner of the horizontal shelf. The roller moved in an offset or elliptical guide channel. At each 180° transition the roller is forced to follow an elliptical or arc path so that the shelf is rotated 180° in the opposite direction from the direction that the chain moves around the top and the bottom sprockets. Again, the entire rotational force placed on the shelf was imparted through the roller acting in the channel, which force eventually caused wear of mechanical parts and resulted in binding and accelerated failure.

In other conveyor mechanisms outside of the vending machine art, such as that disclosed in U.S. Pat. No. 3,902,590 issued to Raynor, et al., an endless chain vertical conveyor system with top and bottom 180° transition sprockets for the endless chain is disclosed. A platform which was fastened to the chain through a pivot connection was maintained in a horizontal orientation with a continuously operating planetary gear system. This type of planetary gearing system does not suggest itself for vending machine applications. Further, it has the disadvantage of continuous relative rotation between the sprocket axle and the sun gear, as well as a continuously rotating idler gear. Further, because of chain wear and chain stretch and because of the continuous rotation of the idler gear, relative to a non-rotating shelf gear, this arrangement is likely to result in gear clashing and potentially catastrophic binding and resulting malfunctions or mechanical difficulties. Such a device was not acceptable for the relatively low power application in a vending machine.

Another planetary gearing mechanism for maintaining a conveyor tray in the same angular orientation around transfer points is disclosed in U.S. Pat. No. 2,965,214 to Schlumphf, et al. In particular, a vertical conveyor embodiment was shown in which a sun gear was held in a non-rotating position coaxial with the chain sprocket, which sprocket rotated as the chain and tray moved therearound. The idler gear moved around the sun gear and rotated on an axle mounted on the sprocket. A tray or a shelf was affixed to a gear which engaged the idler gear at the beginning of each 180° transition and disengaged it at the end of each 180° transition. Again, as with the Raynor, et al. device, the binding and gear clashing which was a likely result, does not suggest this mechanism for use in a vending machine. Any chain wear or chain stretch which might be common with roller chains of the type which are commercially available would likely cause improper gear meshing.

Other conveyor systems, as for oven trays and the like, have been used primarily for moving baking trays in a horizontal direction. In these devices, such as the one shown in U.S. Pat. Nos. 2,512,356 to Massiello and 2,493,857 to Cargill, the small vertical rise or fall which occurs at the 180° transition ends of the horizontally moving conveyors was provided through the use of semicircular guide channels in rounded, engaging bosses on either end of the oven trays. The disclosed devices appear to rely primarily upon gravity and sliding during the short vertical fall or rise at the transition ends, rather than from directly applied mechanical force.

SUMMARY OF THE INVENTION

These and other disadvantages of the prior art are overcome and reduced by the present invention, in which a drive mechanism for a horizontal shelf vending machine is provided with first and second spaced apart rotatable sprockets, around which an endless or continuous chain is driven. The chain moves along a straight section in one direction between the sprockets, changes direction by 180° around a sprocket and moves in another straight section in the opposite direction until it again makes a 180° direction change or transition. A plurality of brackets are attached to the continuous chain at predetermined distances along its length for movement therewith upon rotation of the sprockets. A roller means is affixed to each of the plurality of brackets and is positioned for engagement in a corresponding roller guide track which is formed parallel to the straight stretches of chain and formed in an arc around each sprocket at which the 180° transition takes place. The rollers facilitate support of the brackets in a fixed angular relationship with the endless chain as it moves between the sprockets and in a fixed angular relationship with respect to a tangent to the arc of the chain as it moves around the sprockets. A first portion of a track gear is positioned adjacent to and extending approximately 180° around each of the first and second sprockets. A planetary idler gear is rotatably mounted on the bracket for engagement with the track gear as the bracket moves from the first and second straight sections of the chain into the 180° reverse direction transition sections. The planetary gear is sized to have a predetermined gear ratio with respect to the track gear portion. A pinion idler gear is coaxially fixed for co-rotation with the planetary idler gear, thereby forming an idler gear pair rotatably mounted to the bracket. Rotation of the idler gears occurs only when the 180° direction change transition occurs. A shelf gear is rotatably mounted to the bracket and is positioned for engagement with the pinion idler gear. The pinion idler gear and shelf gear are sized so that the gear ratio between them is the same as the gear ratio between the track gear and the planetary idler gear. Thus, the shelf gear is rotated by the pinion gear an angular amount which is equal to the rotation of the planetary idler gear during the 180° reverse direction transition, but in the opposite direction. The shelf gear further has a shelf-receiving boss with flats on it for removably receiving a vending machine shelf. The boss has means thereon such as flats or a rectangular shape for holding the received shelf in a fixed relationship with respect to the shelf gear. The removable shelf is thus maintained in a fixed angular position, relative to a vending machine in which the drive mechanism operates, as it is moved between the sprockets and as it traverses 180° around the first and second sprockets. The planetary gears rotate only during the 180° transition and are maintained in a fixed orientation while the chain, the bracket and the horizontal shelf traverse the straight sections between the sprockets.

According to another feature of the invention, the idler gear pair has a key attached to it in a predetermined orientation. Key slots parallel to the straight sections of the chain are formed in which the key slides, holding the idler gear pair in a fixed angular orientation as it moves straight between the sprockets. Proper insertion of the key into the key slot is insured by both choosing a gear ratio between the track gear and the planetary idler gear which can be expressed as n:1, where n is an odd integer. This insures that the planetary idler gear will rotate an integer number of times, so that the key will be in the same position each time the idler gear begins the 180° transition and each time it leaves the 180° transition.

Thus, the shelves of a vending machine are maintained in a horizontal orientation during the straight section of travel between the sprockets of a continuous chain conveyor and during the 180° transition. The rotational force exerted upon the shelves to maintain them in a horizontal orientation is exerted through a planetary gear system. The planetary gear system incorporates idler gears on brackets, rotatably mounted, which idler gears rotate only during the 180° transition. Thus, meshing engagement between the planetary idler gear and the fixed track gear occurs while the idler gear is stationary and aligned for non-binding engagement.

BRIEF DESCRIPTION OF THE DRAWINGS

These and other objects and advantages will be more fully understood with reference to the following specification, claims and drawings, in which like numerals represent like elements and in which:

DETAILED DESCRIPTION OF THE PREFERRED EMBODIMENTS

Figure 1:
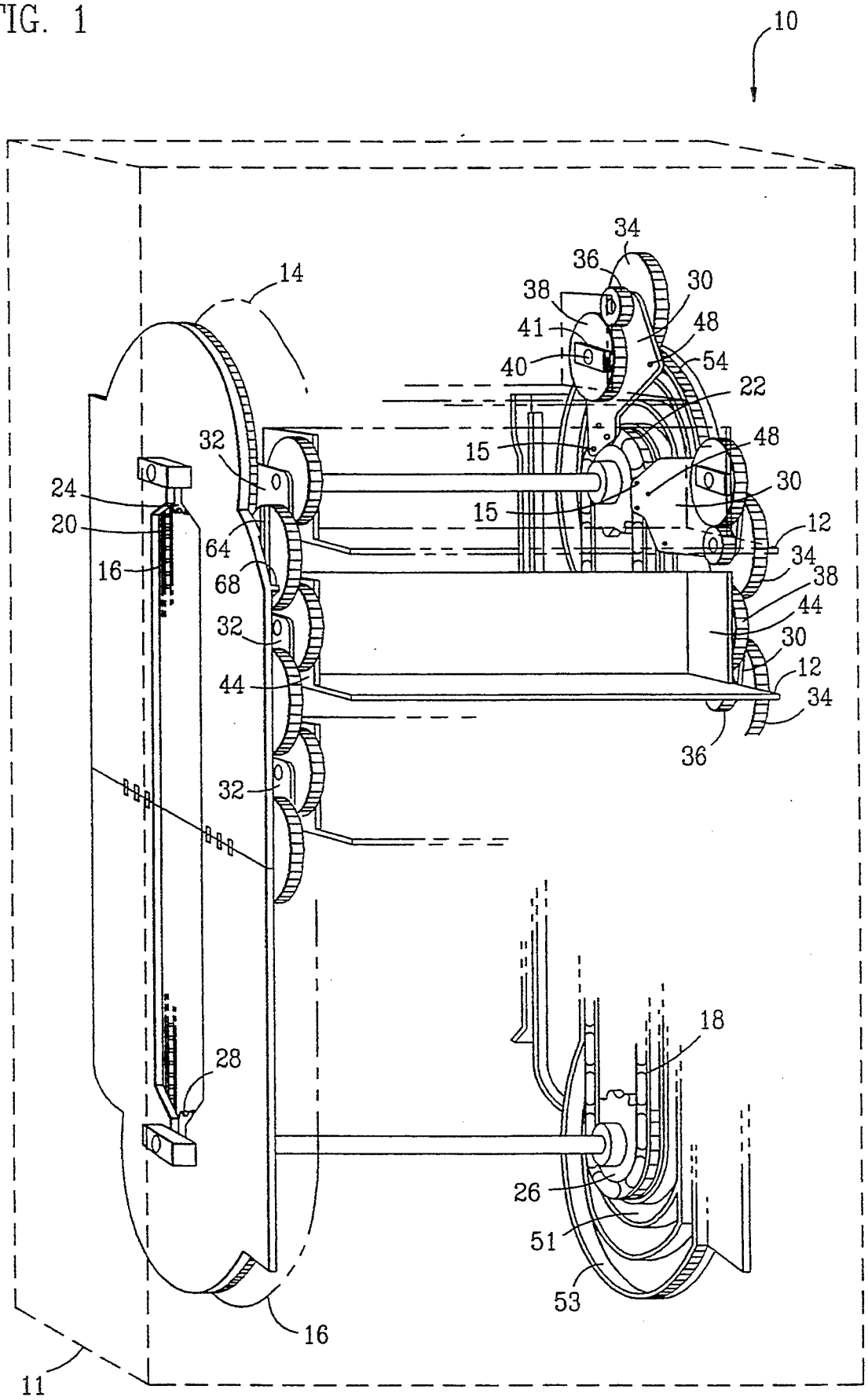
FIG. 1 is a perspective schematic view of a preferred embodiment of a vertical drive mechanism for a horizontal shelf vending machine.

FIG. 1 shows a perspective view of a drive gear mechanism 10 for maintaining multiple vending machine shelves 12 in a horizontal position as they are moved through 180° transition at the ends 14 and 16 of a continuous or endless chain conveyor. In the preferred embodiment, right and left continuous chains 18 and 20 are driven vertically parallel to each other around a pair of coaxial spaced apart top sprockets 22 and 24 and around a pair of coaxially spaced apart bottom sprockets 26 and 28. Multiple pairs of right brackets 30 and left brackets 32 are mounted on vertically separated links 15 on the continuous chains 18 and 20. The plurality of shelves 12 are each detachably mounted to a pair of right 30 and left 32 brackets.

It will be noted that right and left brackets 30 and 32 are substantially the same except for their respective left and right positions. In the preferred embodiment, drive gear mechanism 10 is located at one side of the machine only, and preferably at the left side of the machine. However, it might be located on the right side or it might be substantially duplicated on both sides, as shown in FIG. 1.

For convenience and clarity, the apparatus associated with a drive gear mechanism 10, which might include a left or a right component, or both, with a horizontal shelf suspended therebetween, will be described with respect to the components on one side only as shown in the detailed view of FIG. 2 looking at the side from the middle of the shelves 12, which shelves 12 are shown in phantom lines for clarity. Each bracket 30 is a substantially flat rigid plate 31 which holds a planetary idler gear 34 on one side of the bracket 30 and a coaxially mounted and co-rotated pinion idler gear 36 on the other side of the flat plate of bracket 30. A shelf gear 38 is held on the inside of the bracket 30 for meshing with the pinion idler gear 36. The shelf gear 38 further has a boss 40 formed on it which has means such as flats, as provided by a rectangular shape of boss 40, for holding an engaging clip 42 on each end 44 (shown in FIG. 1) of each horizontal shelf 12. The clips 42 and the flats 41 of rectangular shaped boss 40 removably hold the shelf in a consistent fixed position relative to the shelf gear 38. The shelf gear 38 can rotate with respect to the flat plate bracket 30, but not with respect to the shelf 12 because of the rectangular engaging boss 40. The planetary idler gear 34 and co-rotating pinion gear 36 rotate with respect to the bracket 30, but their rotation is limited by engagement between the pinion idler gear 36 and the shelf gear 38. Each bracket 30 has a roller meads 48 projecting from one side to support the bracket 30 in a fixed orientation from the chain 18. Roller means 48 is guided, upon movement of brackets 30, in roller guide track 46. Preferably, roller means 48 includes a pair of spaced apart rollers 47 and 49, which rollers follow tracks 50 and 52 of roller guide track 46. Tracks 50 and 52 are attached as at fastener orifices 55 to and face inwardly from opposed side walls of a vending machine cabinet or frame (not shown). Tracks 50 and 52 are parallel to straight sections 19 and 21 of the continuous chain 18 at first and second straight sections 43 and 45 between top and bottom sprockets 22 and 26, respectively (as shown in FIG. 1). At the 180° transitions at top 14 and bottom 16, the roller tracks 50 and 52 form first and second arc sections, each including arc transition pathways 51 and 53, respectively, each arc transition pathway with fixed radius about the center of the top and bottom chain sprockets 22 and 26. Thus, brackets 30 are maintained in a fixed orientation with respect to an imaginary tangent to the sprocket at any given point.

At either end of vertical travel, the planetary idler gear 34 engages an external track gear 54 formed and attached to the vending machine frame around an arc defined by the arc transition pathway 53 of roller track 52. Each track gear 54 comprises an approximately 180° portion of a gear which functions similar to a sun gear with respect to the planetary idler gear 34. As the chain 18 and bracket 30 traverse about the 180° transition at top and bottom sprockets 22 and 26, the rollers 48 follow the arc pathways 51 and 53 of tracks 50 and 52 and the planetary idler gear 34 is driven in rotation as it traverses around the 180° track gear 54.

The gear ratio between the track gear 54 and the planetary idler gear 34 is the same as the gear ratio between the shelf gear 38 and the pinion idler gear 36. In this manner, when the planetary idler gear 34 traverses around the track gear 54, it is rotated. Rotation of planetary idler gear 34 correspondingly causes the coaxially mounted pinion idler gear 36 to rotate. In turn, the rotation of pinion idler gear 36 proportionally causes the shelf gear 38 to rotate in the opposite direction, so that the shelf gear 38 is maintained in its same angular position throughout the 180° transition. This maintains the horizontal orientation of the shelf 12 which is held on the rectangular shelf boss 40 which is affixed to the shelf gear 38.

The horizontal position of shelf 12 is maintained by selecting a ratio of sun or track gear 54 to planetary idler gear 34 which ratio is the same as the ratio of the shelf gear 38 to the pinion idler gear 36. Further, by selecting a ratio of 3:1 for both sets of gears, the planetary idler gear 34 makes exactly two revolutions during the 180° transition. This makes it possible to mechanically capture a key 64 on the planetary idler gear in the same fixed angular position each time it leaves either the top or bottom 180° track gear segment.

Figure 2:
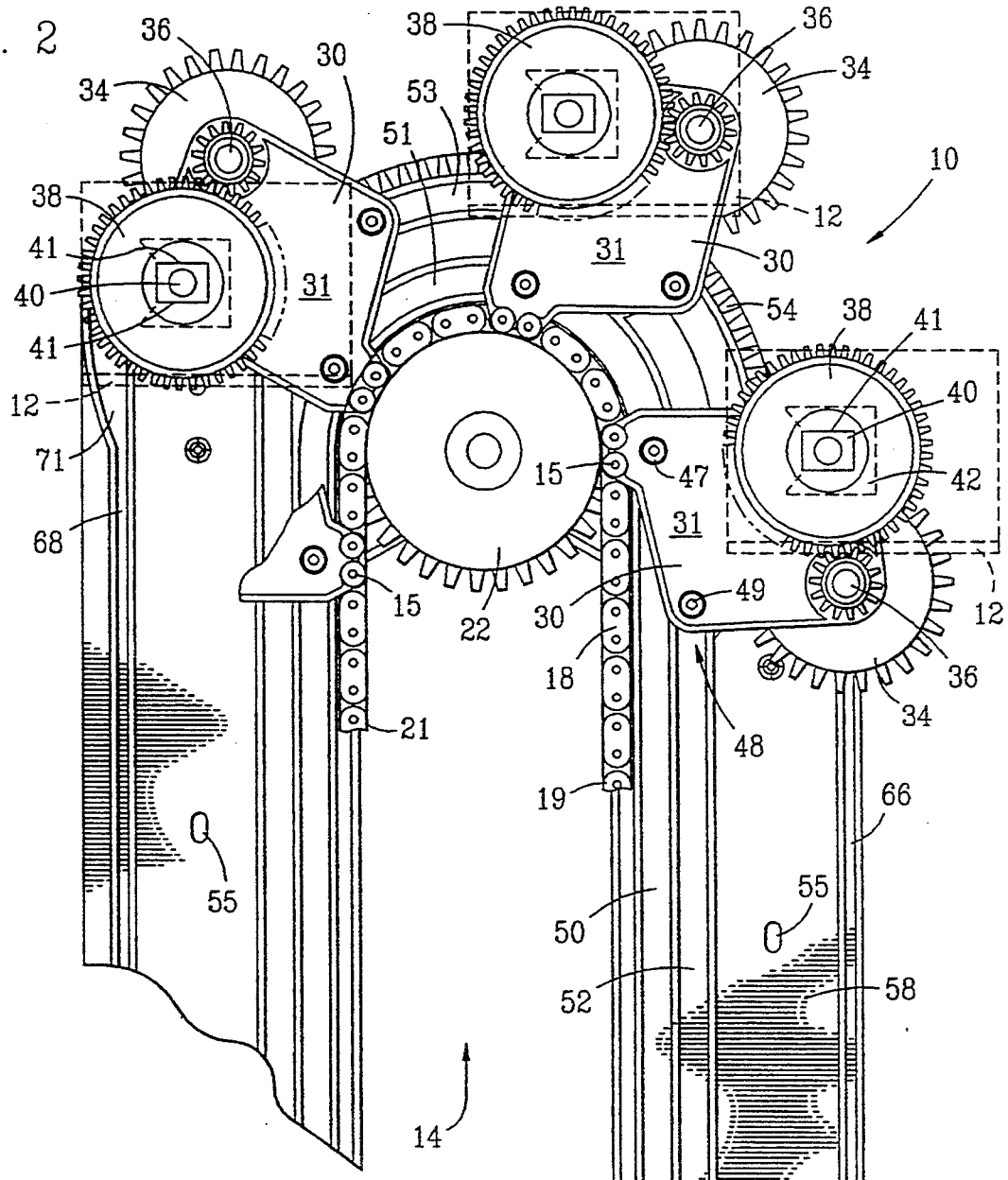
FIG. 2 is a partial schematic cross-sectional view taken along section line 2—2 of FIG. 1 showing a 180° transition end with a fixed track gear and representative horizontal shelf-holding brackets, each with planetary idler gears and a shelf holding gear according to the present invention.
Figure 3:
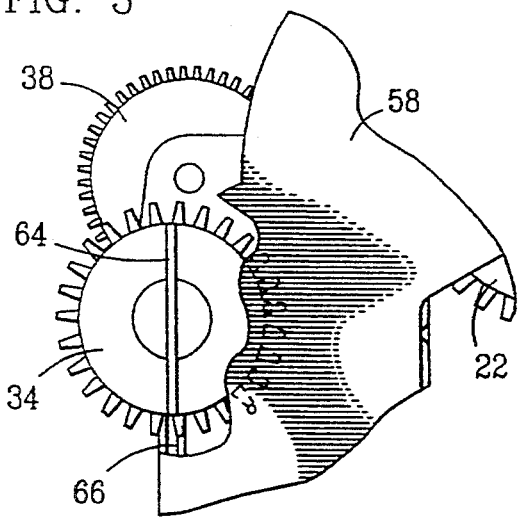
FIG. 3 is a partial cut-away side view of a bracket, a planetary idler gear, a pinion gear, and a shelf gear in an assembly according to the present invention.
Figure 3:
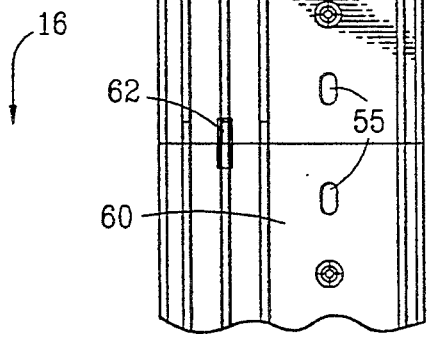
Figure 4:
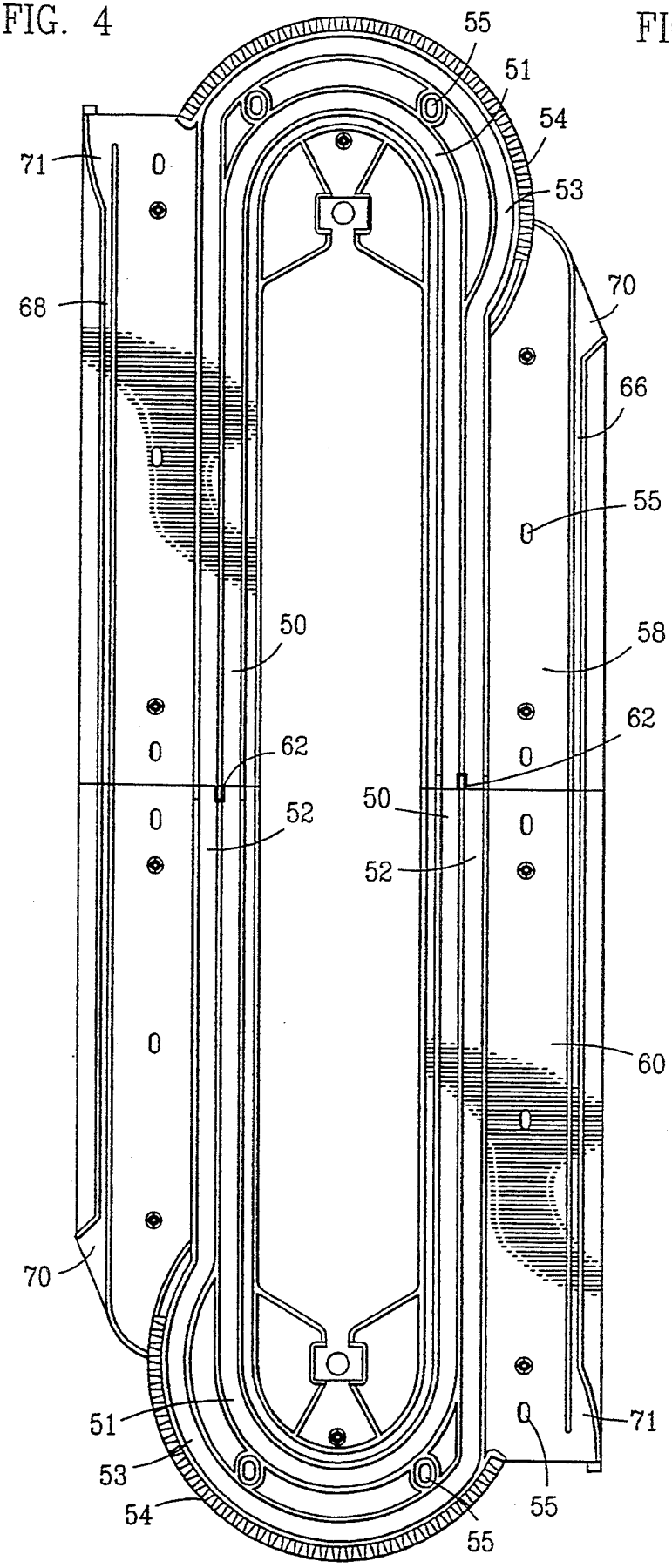
FIG. 4 is a side schematic view of molded guide channels and transition track gears in which the top and the bottom molded guide channels and transition track gears are formed of two identical injection molded pieces merely positioned and interconnected in opposite top and bottom directions.

Preferably, as shown in FIG. 3, with reference also to FIGS. 2 and 4, a vertical key 64 is formed on or affixed to the planetary idler gear 34 and a front key slot 66 or front guideway 66 and a back key slot 68 are formed aligned vertically parallel to the straight sections 19 and 21 of the chain between each 180° transition. The planetary idler gear 34 is thus held by sliding key 64 in either key slot 66 or 68 so that the shelf 12, which moves only if gear 34 moves, is horizontal through the entire vertical travel. The planetary idler gear 34 meshes smoothly with track gear 54 each time it approaches the 180° transition at the end of the vertical travel. The key slot 66 terminates at 70 simultaneously with the engagement between the planetary idler gear 34 with the track gear 54. A widened slot exit portion at 70 allows smooth exit of key 64. A widened entry portion 71 allows smooth entry of key 64 into rear key slot 68. The planetary idler 34 gear and the pinion idler 36 gear which form an idler gear pair 72 are thus maintained in a fixed position through the entire vertical lift or vertical fall. The shelf gear 38 is likewise held in a fixed position through engagement with the fixed pinion idler gear 36 and the horizontal position of the shelf 12 is maintained with rectangular boss 40 as the brackets 30 traverse from top to bottom and around each 180° top and bottom transition.

Figure 5:
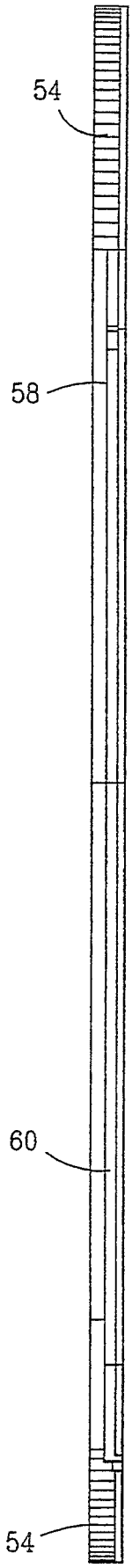
FIG. 5 is an end view of the molded guide channels and transition gear tracks of FIG. 4.

It will be further understood referring to the schematic side and end views of FIGS. 4 and 5, that the apparatus 10 embodied in a vending machine advantageously includes geometry of the top and bottom track gears and roller tracks which permits one injection molding to be used to form a top unit 58 and the bottom unit 60. Thus, the top and the bottom of the vending machine may be assembled with identical injection molded one-half panel units. The right side is the mirror image of the left side so that opposite sides are mounted facing inwardly from two sides of a vending machine cabinet. Interconnecting projections 62 are provided to properly align each top and bottom unit and to insure smooth operation of rollers 47 and 49 in tracks 50 and 52.

Thus, what has been disclosed is a vertical drive mechanism for a vending machine which reliably maintains a shelf in a fixed horizontal position. The track gear and idler gearing mechanism act without undue stress on guide rollers to counter-rotate the shelves during the 180° top and bottom transition so that the shelves are maintained in a horizontal orientation.

Other alterations and modifications of the invention will likewise become apparent to those of ordinary skill in the art upon reading the present disclosure, and it is intended that the scope of the invention disclosed herein be limited only by the broadest interpretation of the appended claims to which the inventors are legally entitled.

What is claimed is:

1. A drive mechanism for movement of a horizontal shelf in a vending machine comprising:

(a) first and second spaced apart rotatable sprockets;

(b) a continuous chain of a size for engagement with and of a length for extending around said first and second spaced apart sprockets with straight sections of said continuous chain therebetween;

(c) a bracket attached to said continuous chain supported in a fixed angular relationship to said chain and at predetermined distances along the length of said chain for movement therewith upon rotation of said sprockets;

(d) a first track gear affixed adjacent to and extending approximately 180° around said first sprocket;

(e) a second track gear affixed positioned adjacent to and extending approximately 180° around said second sprocket;

(f) a planetary idler gear rotatably mounted on said bracket for engagement with each of said track gears at ends of said first and second straight sections of said chain and sized for a predetermined gear ratio with said track gears;

(g) a pinion idler gear coaxially affixed for co-rotation with said planetary idler gear thereby forming an idler gear pair mounted to said bracket for rotation relative to said bracket;

(h) a shelf gear mounted to said bracket for rotation relative thereto, positioned for engagement with said pinion idler gear, and sized for having a gear ratio with respect to said pinion idler gear which is the same as said predetermined gear ratio which said track gear has with respect to said planetary idler gear, such that said shelf gear rotates the same angular amount as said planetary idler gear in the opposite direction from said planetary idler gear; and (i) a shelf receiving boss rigidly affixed to said shelf gear with means thereon for receiving and holding a shelf in a fixed relationship relative to said shelf gear thereby holding said shelf in a same angular position relative to said drive mechanism as said bracket traverses 180° around said first and second sprockets.

2. A drive mechanism for moving a horizontal shelf in a vending machine as in claim 1 further comprising left and right coaxial first and second sprockets, left and right chains, left and right brackets, left and right opposed track gears, left and right planetary, idler, and shelf gears and left and right shelf bosses for holding a horizontal shelf therebetween.

3. A drive mechanism for moving a horizontal shelf in a vending machine as in claim 1 wherein said first and second sprockets are vertically spaced apart and said shelf is held horizontally throughout.

4. A drive mechanism for moving a horizontal shelf in a vending machine as in claim 1 wherein said idler gear pair have an elongated key affixed thereto and a key slot rigidly affixed to said vending machine extends adjacent each straight section of said chain for holding said idler gear pair in a fixed angular position during travel between said first and second spaced apart sprockets.

5. A drive mechanism for moving a horizontal shelf in a vending machine as in claim 4 wherein said predetermined gear ratio between said track gear and said planetary idler gear is 3:1, such that said planetary idler gear rotates exactly two times during each 180° transition, and so that said elongated key always engages said key slot in an orientation parallel to said straight section of said chain.

6. A drive mechanism for movement of a horizontal shelf in a vending machine as in claim 1 further comprising a roller means affixed to said bracket and a corresponding roller guide track in which said roller means is guided upon movement of said bracket and which roller guide track has a first straight section between said first and second sprockets and a first and second arc section partially around said first and second sprockets and a second straight section between said first and second sprockets by which said bracket is supported in a fixed angular relationship with said continuous chain as it moves between said sprockets and a fixed angular relationship with respect to a tangent to said continuous chain as it moves around said sprockets.

7. A drive mechanism for moving a horizontal shelf in a vending machine as in claim 6 wherein said roller means comprises left and right roller means and said roller guide track comprises left and right roller guide tracks mounted to opposed interior sides of said vending machine.

8. A drive mechanism for movement of a plurality of horizontal shelves in a vending machine comprising:

(a) first and second spaced apart rotatable sprockets;

(b) a continuous chain of a size for engagement with and of a length for extending around said first and second spaced apart sprockets with straight sections of said continuous chain therebetween;

(c) a plurality of brackets attached to said continuous chain supported in a fixed angular relationship to said chain and at predetermined distances along the length of said chain for movement therewith upon rotation of said sprockets;

(d) a first track gear affixed adjacent to and extending approximately 180° around said first sprocket;

(e) a second track gear affixed positioned adjacent to and extending approximately 180° around said second sprocket;

(f) a plurality of planetary idler gears rotatably mounted on said plurality of brackets for engagement with each of said track gears at ends of said first and second straight sections of said chain and sized for a predetermined gear ratio with said track gears;

(g) a plurality of pinion idler gears coaxially affixed for co-rotation with said plurality of planetary idler gears thereby forming an idler gear pair mounted to said bracket for rotation relative to said plurality of brackets;

(h) a plurality of shelf gears mounted to said plurality of brackets for rotation relative thereto, positioned for engagement with said pinion idler gears, and sized for having a gear ratio with respect to said pinion idler gears which is the same as said predetermined gear ratio which said track gears have with respect to said plurality of planetary idler gears, such that said shelf gears rotate the same angular amount as said planetary idler gears in the opposite direction from said planetary idler gears; and (i) a shelf receiving boss rigidly affixed to said shelf gears with means thereon for receiving and holding shelves in a fixed relationship relative to said shelf gears thereby holding said shelves in a same angular position relative to said drive mechanism as said brackets traverse 180° around said first and second sprockets.

* * * * *